United States Patent [19]

Meyer

[11] 3,982,305

[45] Sept. 28, 1976

[54] SHOULDER STRAP HOLDER PIN

[75] Inventor: Ruth Meyer, Brooklyn, N.Y.

[73] Assignee: The Raymond Lee Organization, Inc., New York, N.Y. ; a part interest

[22] Filed: Sept. 9, 1975

[21] Appl. No.: 612,013

[52] U.S. Cl. ..... 24/85 R

[51] Int. Cl.[2] ..... A44B 21/00

[58] Field of Search ..... 24/150, 73, 85, 86, 24/76, 82, 84 H, 259 A, 6, 7, 49 CP, 85 R, 73 GS, 73 LF

[56] References Cited

UNITED STATES PATENTS

| | | | |
|---|---|---|---|
| 359,365 | 3/1887 | Sink | 24/85 R |
| 546,920 | 9/1895 | Freund | 24/85 R |
| 714,538 | 11/1902 | Walter | 24/85 R |
| 1,110,446 | 9/1914 | Lange | 24/85 R |
| 1,389,304 | 8/1921 | Holmes | 24/73 GS |
| 1,591,263 | 7/1926 | Aymer | 24/259 A |
| 2,079,045 | 5/1937 | Schlaepfer | 24/85 R |
| 2,932,869 | 4/1960 | Neubig | 24/85 R |

FOREIGN PATENTS OR APPLICATIONS

| | | | |
|---|---|---|---|
| 1,052,729 | 2/1957 | Germany | 24/85 R |

*Primary Examiner*—Donald A. Griffin
*Attorney, Agent, or Firm*—Howard I. Podell

[57] ABSTRACT

A pin assembly adaptable for fastening to the exterior shoulder section of a garment for the detachable retention of a shoulder strap of a bag worn simultaneously with the garment. The assembly is formed of a U-shaped frame to the underside of which a pin is pivotaly mounted, with a hook fixed to the underside of the frame for retention of the end of the pin. A bar is pivotably mounted between the legs of the U-section frame to the frame, with detents on the legs serving to hold the bar in frictional engagement in the closed position of the bar between the frame legs. The bar is mounted at a spaced distance from each of the two frame legs to permit a shoulder strap of a bag to pass over the frame legs and under the bar when the assembly is pinned to the exterior of the shoulder section of a garment worn by the user.

2 Claims, 5 Drawing Figures

SHOULDER STRAP HOLDER PIN

SUMMARY OF THE INVENTION

My invention is a pin assembly adaptable for fastening to the exterior shoulder section of a garment for the detachable retention of a shoulder strap of a bag worn simultaneously with the garment. The assembly is formed of a U-shaped frame to the underside of which a pin is pivotably mounted, with a hook fixed to the underside of the frame for retention of the end of the pin. A bar is pivotably mounted between the legs of the U-section frame to the frame, with detents on the legs serving to hold the bar in frictional engagement in the closed position of the bar between the frame legs. The bar is mounted at a spaced distance from each of the two frame legs to permit a shoulder strap of a bag to pass over the frame legs and under the bar when the assembly is pinned to the exterior of the shoulder section of a garment worn by the user.

My invention readily retains the shoulder strap of a handbag in a fixed position on the shoulder of the wearer and permits ready detachment or attachment of the shoulder strap to the assembly by rotation of the bar to the open or closed position. The assembly may be readily pinned or unpinned to the shoulder section of a garment.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
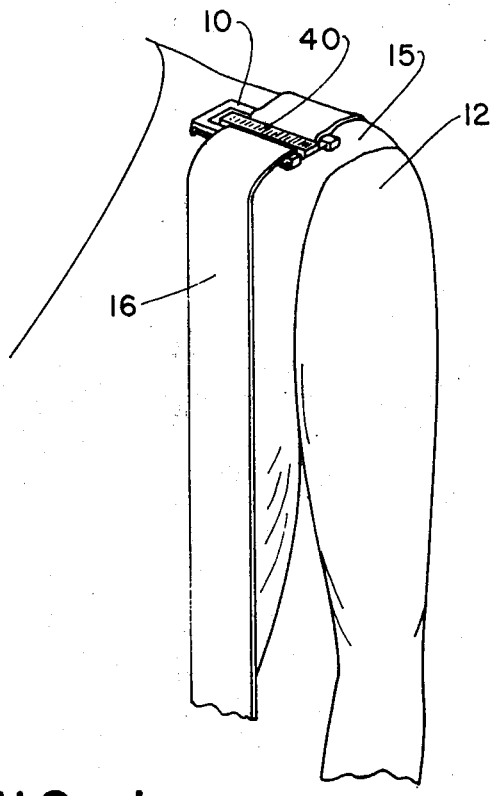
FIG. 1 is a perspective view of the invention in use.
Figure 4:
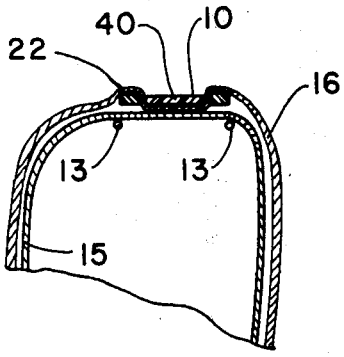
FIG. 4 is a sectional view of the invention and an attached shoulder strap.

Turning now descriptively to the drawings, in which similar reference characters denote similar elements throughout the several views, FIGS. 1 and 4 illustrate the holder assembly 10 fastened by pin 13 about the exterior shoulder section of a garment 15 so as to retain the shoulder strap 16 of a handbag (not shown) upon the shoulder of the wearer 12.

As shown in FIGS. 1–5, the holder 10 is formed of a U-shaped frame 21, shaped with two spaced apart leg members 22 joined to a common base section 23, with frame 21 pivotably fastened to a U-shaped pin 13 pivotably mounted to the underside of frame 21 and frame 21 pivotably fastened to a bar member 40 mounted between the frame leg members 22.

Figure 5:
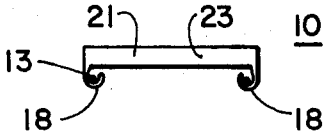
FIG. 5 is an end view of the invention.

U-shaped pin 13 is pivotably mounted through holes at the end 29 of each leg member 22 to extend along the underside of the leg members, with the pointed end 14 of each leg of pin 13 adaptable for piercing through a section of a shoulder garment 15 and extending beyond a hooked latch projection 18 mounted to the underside of each frame leg member 22 so that each leg of pin 13 may be latched in engagement with hooked latch 18, as shown in FIG. 5.

Bar 40 is of a size to fit in between frame leg members 22 with sufficient space between bar 40 and each leg member 22 to allow a bag strap 16 to pass under bar 40 and over each leg member 22, with strap 16 passing between bar 40 and each leg member 22.

Figure 2:
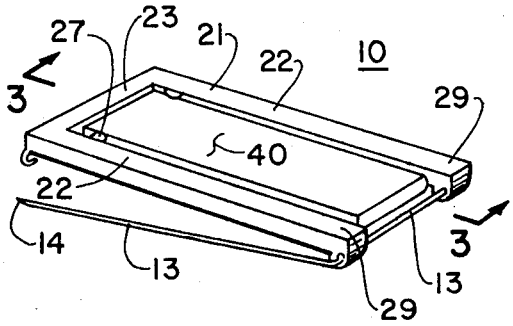
FIG. 2 is a perspective view of the invention.
Figure 3:
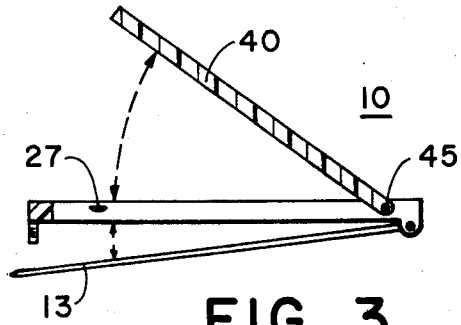
FIG. 3 is a sectional view of the invention taken along line 3—3 of FIG. 2.

A detent 27 projects from each leg member sideways to frictionally engage bar member 40 when bar member 40 is in the closed position, shown in FIG. 2, so as to retain bar 40 in said closed position, but to enable bar 40 to be manually rotated to the open position, shown in FIG. 3. Bar 40 is mounted by pin 45 which passes through the end 29 of each leg member so that a strap 16 fitted about the underside of bar 40 and the exterior side of each leg member 22 is prevented from sliding endwise along bar 40 by frame section 23 between leg members 22.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States:

1. An assembly adaptable for fastening to a garment over an external surface of said garment for the purpose of retaining a strap in detachable engagement over the garment comprising, a flexible strap adaptable for suspension of a bag, a frame member in the form of a U-shaped section formed with two generally parallel spaced leg sections joined to a common base section, at a first end of each leg section, means fixed to the frame member for attachment of the assembly to a garment with the underside of the assembly lying adjacent the garment, and a bar member pivotably mounted to the frame member between the said leg sections of the frame member so as to rotate in a plane perpendicular to the plane of the axes of the said leg sections, with the said bar member fitted, adjacent a first end, to pivot means joined to each of said leg sections adjacent to the second end of each leg section, with the length of said bar member from said pivot means to the second end of said bar member being not greater than the length of each said leg section, so as to permit the bar member to rotate about said pivot means to a rest position in which it lies within the general confines of the frame and lies with the axis of the bar member parallel to the axes of the said leg sections, said bar member being spaced from each leg section, in said rest position, by the general thickness of said strap, so that the strap. when passed over the outer side of the assembly about each leg member and under the underside of the assembly about the bar member, is frictionally engaged to the frame member, said engaged strap being releaseable from engagement to said frame member, by manual rotation of the bar member away from the underside of the said frame member.

2. The combination as recited in claim 1 in which detent means are fixed to the assembly to retain the bar member in frictional engagement in the rest position.

* * * * *